United States Patent [19]

Howell, Jr.

[11] 4,063,969

[45] Dec. 20, 1977

[54] TREATING ALUMINUM WITH TANNIN AND LITHIUM

[75] Inventor: John K. Howell, Jr., Rochester, Mich.

[73] Assignee: Oxy Metal Industries Corporation, Warren, Mich.

[21] Appl. No.: 656,216

[22] Filed: Feb. 9, 1976

[51] Int. Cl.[2] ..... C23F 7/00

[52] U.S. Cl. ..... 148/6.27; 148/6.15 R; 106/14

[58] Field of Search ..... 148/6.14 R, 6.27, 6.15 R; 106/14; 252/8.57; 8/44.32, 94.3, 94.33, 94.26

[56] References Cited

U.S. PATENT DOCUMENTS

| | | | |
|---|---|---|---|
| 2,146,838 | 2/1939 | Newsome et al. | 148/6.27 |
| 2,146,840 | 2/1939 | Newsome et al. | 148/6.27 |
| 2,502,441 | 4/1950 | Dodd et al. | 148/6.15 R |
| 2,550,328 | 4/1951 | Cohn | 148/6.27 |
| 2,851,385 | 9/1958 | Spruance, Jr. et al. | 148/6.27 |
| 2,854,368 | 9/1958 | Shreir | 148/6.15 R |

*Primary Examiner*—Ralph S. Kendall

*Attorney, Agent, or Firm*—Arthur E. Kluegel; Bertram F. Claeboe; Richard P. Mueller

[57] ABSTRACT

Disclosed are an improved composition and process for the treatment of aluminum surfaces for the purpose of imparting corrosion resistance and improved receptivity of an organic finish. A lithium compound is added to an aqueous tannin composition to obtain this effect.

14 Claims, No Drawings

TREATING ALUMINUM WITH TANNIN AND LITHIUM

BACKGROUND OF THE INVENTION

This invention relates to the art of chemically treating an aluminum surface. More specifically, it relates to the art of treating an aluminum surface to improve both the corrosion resistance of a bare surface and the adhesion of an organic finish subsequently applied to the treated surface. This invention also concerns a composition and process for accomplishing the foregoing results without causing the waste disposal problems created by the use of compositions containing large concentrations of phosphate and/or hexavalent chromium compounds.

The use of tannins in connection with metal treating has been suggested by the prior art. U.S. Pat. No. 2,502,441 discloses an alkali metal phosphatizing solution containing a two-component accelerator which may be used for the treatment of iron and steel surfaces and also possibly for other metals such as aluminum. The accelerator portion of the composition contains either a molybdenum or tungsten compound and a phenolic substance such as a tannin. The patentee notes, however, that if the alkali metal phosphate plus tannin is used without the molybdenum compound, deposition of a coating seems to be completely inhibited. U.S. Pat. No. 2,854,368 teaches the use of a phosphoric acid solution containing a tannin for the treatment of iron or steel and also possibly for other metals such as aluminum. The most dilute solution suggested by the patentee is one containing one mole of phosphoric acid per liter and one weight percent tannin.

SUMMARY OF THE INVENTION

It has now been discovered that the corrosion resistance imparted to an aluminum surface by an aqueous tannin containing composition can be improved by including a soluble lithium compound in the treating composition. The presence of the lithium compound improves corrosion resistance without detrimentally affecting the adhesion of a subsequently-applied organic finish. The lithium compound should be present in an amount, at least 0.001 g/l, sufficient to improve corrosion resistance imparted by the treating solution. The improved results obtained from the addition of lithium are not evident when other alkali metals or ammonium are employed in equal amounts.

DETAILED DESCRIPTION OF THE INVENTION

The chemistry of tanning agents is not completely understood. They include a large group of water soluble, complex organic compounds widely distributed throughout the vegetable kingdom. All have the common property of precipitating gelatin from solutions and of combining with collagen and other protein matter in hides to form leather. All tannin extracts examined contain mixtures of polyphenolic substances and normally have associated with them certain sugars. (It is not known whether these sugars are an integral part of the structure.) For a discussion of tannins, see *Encyclopedia of Chemical Technology,* second edition, Kirk-Othmer; XII (1967) pp. 303–341 and *The Chemistry and Technology of Leather,* Reinhold Publishing Corporation, New York, pp. 98–220 (1958).

Tannins are generally characterized as polyphenolic substances having molecular weights of from about 400 to about 3000. They may be classified as "hydrolyzable" or "condensed" depending upon whether the product of hydrolysis in boiling mineral acid is soluble or insoluble, respectively. Often extracts are mixed and contain both hydrolyzable and condensed forms. No two tannin extracts are exactly alike. Principal sources of tannin extracts include bark such as wattle, mangrove, oak, eucalyptus, hemlock, pine, larch, and willow; woods such as quebracho, chestnut, oak and urunday, cutch and turkish; fruits such as myrobalans, valonia, divi-divi, tera, and algarrobilla; leaves such as sumac and gambier; and roots such as canaigre and palmetto.

The term "vegetable tannins" is employed to distinguish organic tannins such as those listed in the previous paragraph from the mineral tanning materials such as those containing chromium, zirconium and the like. Experimental work has shown that hydrolyzable, condensed, and mixed varieties of vegetable tannins may all be suitably used in the present invention. Quebracho and chestnut have been found to be very effective condensed tannins and myrobalan an effective hydrolyzable tannin.

Very small concentrations of the tannin extract have been found effective for improving the corrosion resistance and organic finish adhesion of an aluminum surface. The concentration to be used depends upon the particular tannin employed, the processing conditions selected and the quality and thickness of the resulting coating. If all conditions are properly adjusted, concentrations as low as 0.000025 weight percent are effective. Generally, the tannin concentration will be between this lower limit and 25 weight percent and, under the usual conditions, between about 0.002 and 0.25 weight percent. Most preferably, the concentration will be about 0.025 weight percent. Lower concentrations do not produce an appreciable improvement in characteristics, and higher concentrations result in an increased dragout of valuable chemicals on the workpieces. The pH of the aqueous solution must be adjusted to a value of at least 3 and is preferably less than about 9 and most preferably between 4 and 8. A pH somewhat on the acid side (as low as about 3) is typically obtained when a natural extract is dissolved in water. pH values below 3 do not produce the desired improvement in properties, and there is generally no reason to adjust to a pH above 9. Conventionally, the pH may be adjusted with any compatible acid or base typically used for that purpose such as hydrochloric, sulfuric, phosphoric, hydrofluoric, nitric or acetic acids and the alkali metal hydroxides, carbonates or silicates. Only very small amounts are usually necessary for this purpose.

Aside from the mentioned pH adjuster, additional compatible components may optionally be included in the solution such as accelerators, surfactants and chelating agents. It is advantageous to include a small quantity of a soluble titanium compound, at least 0.003%, sufficient to further enhance the effect of the tannin. Examples of suitable titanium compounds include fluotitanic acid titanium or titanyl sulfate and ammonium or alkali metal-halide double salts such as potassium titanium fluoride. The addition of a fluoride compound (simple or complex) is also advantageous. It acts to promote the reaction between the tannin and the aluminum surface and may also serve to solubilize titanium if desired. Where employed, concentrations of at least 0.006% F are preferred. Where phosphate is employed, at least 0.001% is suitable.

The lithium content should be an amount, at least 0.001 g/l, sufficient to impart improved corrosion resistance to the treated surfaces. Preferably, the lithium content is at least 0.01 g/l. Any soluble lithium compound may be employed which does not contribute deleterious cations or anions to the solution. Suitable lithium compounds may include, for example, the oxide, hydroxide, nitrate, sulfate, chloride, fluoride and phosphate.

Depending upon the qualities required of the final product, further embodiments have been found advantageous. Where a sequential or two-stage tannin treatment is employed, the resulting coating exhibits excellent paint adhesion with a wide variety of paints. It has also been found preferable to employ a fluoride containing acid cleaner in advance of the tannin treatment.

The tannin treatment processing conditions of temperature, contact time and contact method are interdependent. Spray, immersion, and roll-on techniques may be employed. Contact times of as low as 0.1 seconds and temperatures of 90° to 150° F are suitable. In the case of can manufacture, application of the chemicals is conventionally by the spray technique and, considering normal plant operations, the temperature of the solution will normally be from 90° to 150° F, preferably 90° to 125° F (most preferably 100°-105° F) and the contact time will normally be between 0.1 and 30 seconds and preferably between 5 and 30 seconds. Contact times of less than 5 seconds and usually less than one second are required in conduit processing of containers as described, for example, in U.S. Pat. No. 3,748,177 which is incorporated herein by reference. Of course, with suitable adjustment of the solution or processing conditions, values could be outside the above normal ranges.

The following tests were employed to evaluate the corrosion resistance of the treated aluminum surface:

TR-3 BARE CORROSION

This test is a measure of the resistance to discoloration of a treated but unpainted aluminum surface. The surface is immersed in an aqueous solution containing 82.4 mg/l NaCl and 220 mg/l $NaHCO_3$ at 150° F for 30 minutes. After water rinsing and drying, the color of the surface is observed. Only very slight discoloration is acceptable. Severe golden-brown discoloration is unacceptable.

EXAMPLE 1

A treating solution was prepared to contain:

| Component | g/l | |
|---|---|---|
| $TiOSO_4$ | 0.06 | Ti |
| HF (70%) | 0.5 | F |
| $H_3PO_4$ (75%) | 0.05 | $PO_4$ |
| Chestnut Extract | 0.14 | |
| NaOH | 0.02 | |
| LiOH (10%) | 0.22 | Li |
| pH | 5.5 | |

Aluminum surfaces were then treated according to the spray process sequence:

1. Hot water rinse, 15 seconds.
2. Acid cleaner, 30 seconds.
3. Hot water rinse, 15 seconds.
4. Treating solution, 20 seconds, 120° F.
5. Cold water rinse, 15 seconds.
6. Deionized water rinse, 15 seconds.
7. Oven dry, 350° F, 3 minutes.

The same process sequence was repeated using ammonium hydroxide in place of the lithium hydroxide to obtain the same pH value. For further comparison, the sequence was repeated again but a conventional chromate composition was employed in Step 4.

The treated but unpainted can bottoms were then subjected to the TR-3 Bare Corrosion test. Upon observation, the lithium containing tannin treatment and conventional chromate treatment gave only very slight discoloration whereas the lithium-free tannin treatment gave an unacceptable light gold color.

When sodium hydroxide was employed instead of either lithium or ammonium hydroxide, even darker coloring was observed.

EXAMPLE 2

A treating solution was prepared to contain:

| Component | g/l | |
|---|---|---|
| $TiOSO_4$ | 0.13 | Ti |
| HF (70%) | 0.95 | F |
| $H_3PO_4$ (75%) | 0.094 | $PO_4$ |
| Chestnut extract | 0.155 | |
| NaOH | 0.0075 | |
| $LiOH \cdot H_2O$ | 0.013 | Li |
| $NH_3$ | 0.796 | |
| pH | 5.0 | |

Aluminum (5050 alloy) panels were then processed as follows:

1. Alkaline cleaner — 160° F, 10 seconds
2. Hot Water rinse — 10 seconds
3. Treating solution, 120° F, 5 second spray
4. Cold water rinse, 5 seconds
5. Aqueous tannin post-treatment — 3 seconds (0.25 g/l quebracho extract, pH 5)
6. Squeegee and air dry Panels were also run using steps 1, 2 and 6 only, giving cleaned only control panels. Sets of both treated and cleaned only panels were painted immediately and another set of treated panels was aged three months prior to painting. The panels were painted with Mobil's S-9009-105 vinyl-based paint and subjected to testing.

Panels were immersed in boiling deionized water for 10 minutes. After cross-hatching of the surface and drying, Scotch-brand transparent tape (#610) was applied and removed from the cross-hatched surface. The results were then rated from 10 (no paint removal) to 0 (complete paint removal). Similarly immersed panels were bent 180° without a mandrel and tape pulled along the flat panel surface adjacent the bend. The results were:

| | TREATED PANELS | | Cleaned |
|---|---|---|---|
| Test | Fresh | Aged | Only |
| Adhesion | 10 | 10 | 5 |
| Bend Adhesion | 10 | 10 | 5 |

EXAMPLE 3

The same treating solution and process cycle were employed as in Example 2 to treat aluminum venetian blind stock. Sherwin-Williams WCEN G705 alkyd paint was applied with a #32 draw-down bar and the paint was then baked for 35 seconds at 550° F. The panels were then placed in a standard acid accelerated paint stripper (ENSIGN 803, Ensign Co.) for 90 seconds, wiped with a rag to observe paint removal. The treated panels gave no removal whereas the cleaned only panels exhibited complete removal.

What is claimed is:

1. An aqueous chromium-free concentrate composition comprising a vegetable tannin compound and a soluble lithium compound in an amount, at least 0.001 g/l, sufficient, when the concentrate is diluted for use, to improve the corrosion resistance of an aluminum surface treated therewith.

2. The concentrate of claim 1 additionally containing a soluble titanium compound.

3. The concentrate of claim 2 wherein the titanium compound is selected from the group consisting of the ammonium or alkali metal-halide double salts, fluotitanic acid and titanium or titanyl sulfate.

4. The concentrate of claim 1 additionally containing a simple or complex fluoride compound.

5. The concentrate of claim 1 additionally containing a phosphate compound.

6. The concentrate of claim 1 wherein the lithium compound is selected from the group consisting of the oxide, hydroxide, nitrate, sulfate, chloride, fluoride and phosphate salts.

7. An aqueous chromium-free composition suitable for treating an aluminum surface to improve the corrosion resistance thereof comprising at least 0.00025 g/l of a vegetable tannin compound and a soluble lithium compound in an amount, at least 0.001 g/l, sufficient to improve the corrosion resistance of an aluminum surface treated therewith.

8. The composition of claim 7 additionally containing a soluble titanium compound.

9. The composition of claim 7 additionally containing a simple or complex fluoride compound.

10. The composition of claim 7 additionally containing a phosphate compound.

11. The composition of claim 7 wherein the pH is between 1 and 9.

12. A process for improving the corrosion resistance of an aluminum surface comprising contacting the surface with the composition of claim 7.

13. The process of claim 12 wherein the composition is maintained at a temperature of at least 90° F.

14. The process of claim 12 wherein the period of contact is at least 0.1 seconds.

* * * * *